US008141475B2

(12) United States Patent
Huettlin

(10) Patent No.: US 8,141,475 B2
(45) Date of Patent: Mar. 27, 2012

(54) PISTON MACHINE

(76) Inventor: Herbert Huettlin, Steinen (DE)

( * ) Notice: Subject to any disclaimer, the term of this patent is extended or adjusted under 35 U.S.C. 154(b) by 24 days.

(21) Appl. No.: 12/771,540

(22) Filed: Apr. 30, 2010

(65) Prior Publication Data

US 2010/0269688 A1 Oct. 28, 2010

Related U.S. Application Data

(63) Continuation of application No. PCT/EP2008/009132, filed on Oct. 29, 2008.

(30) Foreign Application Priority Data

Oct. 31, 2007 (DE) ..... 10 2007 054 321

(51) Int. Cl.
*F01C 3/06* (2006.01)
*F04C 3/06* (2006.01)

(52) U.S. Cl. ..... 92/67; 123/18 R

(58) Field of Classification Search ..... 92/67; 123/18, 123/241, 245
See application file for complete search history.

(56) References Cited

U.S. PATENT DOCUMENTS 2,425,813 A 8/1947 Kuntz
3,598,094 A * 8/1971 Odawara ..... 123/48 R
4,290,341 A 9/1981 Scheibengraber
5,404,849 A 4/1995 Fenton
(Continued)

FOREIGN PATENT DOCUMENTS

CN 1865664 A 11/2006
(Continued)

OTHER PUBLICATIONS

International Preliminary Report on Patentability and Written Opinion of the International Searching Authority; PCT/EP2008/009132; Jun. 22, 2010; 5 pages.

(Continued)

*Primary Examiner* — Thomas E Lazo
(74) *Attorney, Agent, or Firm* — St. Onge Steward Johnston & Reens LLC

(57) ABSTRACT

A piston machine comprises a housing, in which at least one first piston is arranged which can be moved to and fro between two end positions in order to periodically increase and reduce the size of a working chamber adjoining a first end face of the at least one first piston, the at least one first piston having at least one guiding member, which is in engagement with a control curve which is formed on a curve member arranged in the housing, the curve member extending concentrically and circumferentially in the housing, all the way round an axis of revolution which is fixed relative to the housing, and being arranged radially to the outside of the piston in relation to the axis of revolution, a second piston being situated opposite the at least one first piston and performing opposing reciprocating movements relative to the first piston, the second piston having a second end face, which faces the first end face of the first piston, and the working chamber being situated between the end faces. The curve member is mounted in the housing in such a way that it can revolve about the axis of revolution, while the at least one first piston and the second piston cannot revolve about the axis of revolution, with the result that the at least one first piston and the second piston perform reciprocating movements in a plane of movement which is fixed relative to the axis of revolution when the curve member revolves about the axis of revolution.

11 Claims, 7 Drawing Sheets

U.S. PATENT DOCUMENTS

| | | | |
|---|---|---|---|
| 7,658,168 | B2 | 2/2010 | Huettlin |

FOREIGN PATENT DOCUMENTS

| | | | |
|---|---|---|---|
| DE | 10115167 | C1 | 12/2002 |
| DE | 102005024751 | A1 | 8/2006 |
| EP | 0575309 | A1 | 12/1993 |
| WO | 03067033 | A1 | 8/2003 |
| WO | 2006089576 | A1 | 8/2006 |
| WO | 2006122658 | A1 | 11/2006 |

OTHER PUBLICATIONS

International Search Report and Written Opinion of the International Searching Authority; PCT/EP2008/009132; Mar. 9, 2009; 3 pages.

First Office Action; State Intellectual Property Office of People's Republic of China; Application No. CN 200880114367.9; Issued: Dec. 26, 2011; 7 pages.

Notification of Reason(s) for Refusal; Japanese Patent Office; Application No. JP2010-530356; Drafiting Date: Dec. 7, 2011; Dispatch Date: Dec. 15, 2011; 7 pages (including translation).

* cited by examiner

PISTON MACHINE

CROSS REFERENCE TO RELATED APPLICATIONS

The present application is a continuation of pending International Patent Application PCT/EP 2008/009132 filed on Oct. 29, 2008 which designates the United States, and which claims priority of German Patent Application No. 10 2007 054 321.4 filed on Oct. 31, 2007

BACKGROUND OF THE INVENTION

The invention generally relates to piston machines. More specifically, the invention relates to piston machines of the type comprising a housing, in which at least one piston is arranged which can be moved to and fro between two end positions in order to periodically increase and reduce the size of a working chamber, wherein the piston has a guiding member which is in engagement with a control curve of a curve member arranged in the housing.

A piston machine according to the present invention can be used, in particular, as an internal combustion engine. In the present description, the use of the piston machine as an internal combustion engine is presented as the preferred use. However, there are other possible uses of a piston machine according to the present invention, e.g. use of the piston machine as a compressor.

WO 2006/122658 A1 discloses a piston machine which is of the type of a rotary piston machine. A total of four pistons is arranged in the housing of the known piston machine, and these pistons run jointly around an axis of revolution which is fixed relative to the housing. As they run jointly around the axis of revolution, the four pistons perform reciprocating movements, two pistons in each case, which form a piston pair, performing reciprocating movements in opposition to one another in order alternately to increase and reduce the size of a working chamber defined between the end faces of the two pistons of the piston pair. Overall, the known rotary piston machine has two working chambers, and the working chambers increase and decrease in size in the same sense. The four pistons are mounted in a sliding manner in a piston cage which revolves around the axis of revolution together with the pistons.

If the known rotary piston machine is used as an internal combustion engine, the operating strokes of induction, compression, expansion and exhaust take place during the periodic decrease and increase in the size of the volumes of the working chambers.

In this arrangement, the reciprocating movements of the individual pistons are derived from the revolution of the pistons about the axis of revolution since the pistons each have a guiding member which runs in a control curve of a curve member fixed relative to the housing, the control curve having a corresponding undulating contour to enable the reciprocating movements of the pistons to be derived from the revolution of the pistons about the axis of revolution.

If such a rotary piston machine is used as an internal combustion engine, the revolution of the piston cage can be transmitted to an output shaft in order to drive a vehicle, for example.

Further rotary piston machines of a comparable type are known from DE 10 2005 024 751 A1 or from WO 03/067033 A1, for example. In the rotary piston machine known from DE 10 2005 024 751 A1, the curve member is integrated directly into the inner wall of the housing, as is the case also with the rotary piston machine known from WO 03/067033 A1.

With the known piston machines described above, a disadvantage results from the fact that the reciprocating movements of the pistons which define the operating strokes of induction, compression, expansion and exhaust are derived from a revolution of the pistons about the axis of revolution and that the piston cage also necessarily revolves about the axis of revolution together with the pistons. Owing to the revolution of the pistons about the axis of revolution, they are acted upon by centrifugal forces, which lead to friction phenomena, caused by centrifugal forces, between the outer walls of the pistons and the inner wall of the piston rotor since, although the pistons revolve jointly with the piston cage, they have to perform reciprocating sliding movements relative to the piston cage. Owing to the centrifugal forces acting on the pistons, these reciprocating movements are thus subject to friction. The centrifugal forces acting on the pistons therefore impair the running characteristics of the known piston machines.

DE 101 15 167 C1 has furthermore disclosed a high-pressure radial-piston pump, in particular as a fuel pump for injection systems of internal combustion engines. In a pump head, this high-pressure pump has radially movable pump pistons, the reciprocating movements of which are generated by a rotatable cam ring which surrounds the pump pistons and has a correspondingly contoured cam track.

SUMMARY OF THE INVENTION

The object on which the invention is based is to develop a piston machine of the type stated at the outset in such a way that the running characteristics of the piston machine are improved.

According to the invention, a piston machine is provided, comprising a housing, a first piston arranged in the housing and having a first end face, the first piston being movable to and fro to perform reciprocating movements, a second piston arranged in the housing and having a second end face, the second piston being movable to and fro to perform reciprocating movements in opposite direction with respect to the reciprocating movements of the first piston, a working chamber arranged between the first and second end faces, the working chamber periodically increasing and decreasing in size upon the reciprocating movements of the first and second pistons, a guiding element arranged on at least one of the first and second pistons, a curve member arranged in the housing and extending concentrically and circumferentially about an axis of revolution fixed relative to the housing, said curve member being arranged radially outside of the first and second pistons with respect to the axis of revolution, the curve member being rotatable about the axis of revolution, while the first and second pistons being not-rotatable about the axis of revolution, a control curve formed on the curve member, the guiding element being in engagement with the control curve, the first and second pistons performing the reciprocating movements in a plane of movement which is fixed relative to the axis of revolution upon rotation of the curve member about the axis of revolution.

The piston machine according to the invention departs from the concept of rotary piston machines in that the reciprocating movements of the piston or pistons are not derived from a revolving movement of the piston or pistons about the axis of revolution but from a revolution of the curve member about the axis of revolution while the piston or pistons does/do not revolve about the axis of revolution. Centrifugal forces on the piston or pistons relative to the axis of revolution are thus eliminated. The at least one first piston performs its reciprocating movements in a plane of movement which is fixed relative to the axis of revolution whereas, in the case of the known rotary piston machines, the plane of movement of the reciprocating movements of the individual pistons likewise revolves about the axis of revolution.

The piston machine according to the invention also manages with significantly fewer revolving parts than the known rotary piston machines because the revolution of the piston or pistons is dispensed with and only the curve member with its lower mass performs a revolving movement in order to generate the reciprocating movements of the piston or pistons.

The concept of the piston machine according to the invention is advantageously employed in an embodiment in which a second piston is situated opposite the at least one first piston and performs opposing reciprocating movements relative to the first piston as the curve member revolves, the second piston having a second end face, which faces the first end face of the first piston, and the working chamber, in which a working gas, in particular a fuel/air mixture, is compressed, ignited and expanded, being situated between the end faces.

This boxer principle, which is known per se from the document mentioned at the outset for example, in which the two pistons work in opposition, has the advantage that working chambers with a large displacement can be achieved with a relatively small travel of the two pistons.

In a further preferred embodiment, the second piston has a guiding member which is in engagement with the control curve of the curve member.

In this embodiment, the reciprocating movements of the two pistons situated opposite one another are thus derived independently of one another from the revolution of the curve member about the axis of revolution. This has the advantage that no mechanical coupling between the two pistons has to be provided to generate the reciprocating movements of the second piston. Moreover, just one control curve in the curve member is required for the first and the second piston.

In a further preferred embodiment, the axis of revolution extends centrally through the working chamber.

This measure has the advantage that, where the piston machine according to the invention is used as an internal combustion engine, an ignition device for igniting the fuel/air mixture in the working chamber can be arranged in the end of the housing with respect to and on the axis of revolution. Although arrangement of the ignition device on the axis of revolution is also provided in the known rotary piston machine of WO 2006/122658 A1, for example, there is the disadvantage there that the ignition device is passed through a bore in the revolving piston cage, and this can lead to problems of sealing between the ignition device and the revolving piston cage. In the piston machine according to the invention, in contrast, the ignition device can be passed through the housing and thus through a fixed part and sealed easily.

In a further preferred embodiment, the at least one first piston is mounted in a sliding manner in a piston cage which is fixed relative to the housing.

Accommodating the at least one first piston in a piston cage has the advantage that the piston can have a cylindrical shape, allowing the first end face of the at least one first piston to be of circular design and enabling the piston to be mounted in a sliding manner in a circular bore in the piston cage. This too has already been implemented in the rotary piston machine known from WO 2006/122658 A1 but with the difference that there the piston cage revolves about the axis of revolution together with the pistons whereas, in the present embodiment, the piston cage is designed in such a way as to be fixed relative to the housing. The friction between the pistons and the piston cage owing to centrifugal forces which occurs in the known rotary piston machine is therefore avoided in the piston machine according to the invention.

In a further preferred embodiment, a shaft is in operative connection with the curve member, such that the revolution of the curve member is converted into a rotation of the shaft.

Here, the rotary motion is advantageously taken off, to drive a vehicle for example, from the revolving curve member, allowing the rotation of the curve member to be converted directly into rotation of the shaft, thus avoiding complex conversion mechanisms.

It is preferred here if the shaft is connected to the curve member by worm toothing.

In this way, the shaft can advantageously be directly in engagement with the outside of the curve member, thereby eliminating further moving parts between the curve member and the shaft. In this arrangement, the shaft is preferably arranged perpendicularly to the axis of revolution.

In a further preferred embodiment, there is a gas inlet and a gas outlet in the housing, at an end thereof in relation to the axis of revolution, the gas inlet and the gas outlet being opened and closed by means of a rotary slide valve, which has an opening and which revolves about the axis of revolution at the same rotational speed as the curve member.

The piston machine according to the invention advantageously makes it possible for the gas inlet and the gas outlet to be provided in the immediate vicinity of the axis of revolution in the housing end part without the gas inlet and the gas outlet colliding with a revolving part, for example. The use of the rotary slide valve, which has an opening, is a particularly simple way, with advantages in terms of design, of providing an inlet and an outlet valve for introducing a gas, a fuel/air mixture for example, into the working chamber and exhausting a gas, e.g. burnt fuel/air mixture, from the working chamber, and the equality between the rotational speed of the rotary slide valve and the rotational speed of the curve member ensures that the timing of gas induction and gas exhaust is synchronized with the reciprocating movement of the at least one first piston.

To this end, provision is made in an advantageous embodiment that the revolution of the rotary slide valve be derived from the revolution of the curve member via a transmission with a rotational speed ratio of 1:1.

As in the case of the abovementioned shaft, such a transmission can once again be formed by worm toothing between the outside of the curve member and a drive shaft for the rotary slide valve.

In a further preferred embodiment, a total of four pistons is arranged in the housing, of which the at least one first and a second piston form a first piston pair, and a third and a fourth piston form a second piston pair, the second piston pair defining a second working chamber, which is in the same plane as the working chamber defined by the first piston pair, and the reciprocating movements of the first and third piston are in the same direction, and the reciprocating movements of the second and fourth piston are in the same direction.

Although, like the known rotary piston machine, the piston machine in this embodiment of the piston machine according to the invention likewise has four pistons and two working chambers, the two working chambers in the piston machine according to the invention increase and decrease in size in opposite senses, in contrast to the known rotary piston machine, i.e. when one working chamber is at its minimum volume, the other working chamber is at its maximum volume, and vice versa. The advantage here, especially in conjunction with the concept according to the invention that the pistons no longer revolve about the axis of revolution in the housing, is that, on the one hand, as already mentioned above, no centrifugal forces act on the pistons, and, on the other hand, two pistons which are adjacent to one another with the rear sides remote from their end faces, i.e. the first and the third piston and the second and the fourth piston, each move to and fro jointly in the same direction. This reduces vibration in the piston machine during operation.

In the embodiment in which the piston machine has a total of four pistons, the third and the fourth piston each also have a guiding member, the two guiding members engaging in a further control curve of the curve member.

It is advantageous here that the reciprocating movements of all four pistons are guided in a well-defined manner by the curve member.

In a further preferred embodiment, the first piston and the third piston are connected to one another on their mutually facing sides, and the second piston and the fourth piston are likewise connected to one another on their mutually facing sides.

It is advantageous here that it is ensured at all times during a full revolution of the curve member that the guiding members of the pistons are in direct and reliable contact with the respective control curve of the curve member because the connection between the first and third and the second and fourth pistons brings about a mutual drag or entrainment effect between these pistons during the reciprocating movement.

Further advantages and features will emerge from the following description and the attached drawing.

It is self-evident that the features mentioned above and those which remain to be explained in the text which follows can be employed not only in the respectively indicated combination but also in different combinations or alone without exceeding the scope of the present invention.

BRIEF DESCRIPTION OF THE DRAWINGS

An illustrative embodiment of the invention is depicted in the drawing and is described in greater detail below with reference to the latter. In the drawing.

DETAILED DESCRIPTION OF A PREFERRED EXEMPLARY EMBODIMENT

Figure 7:
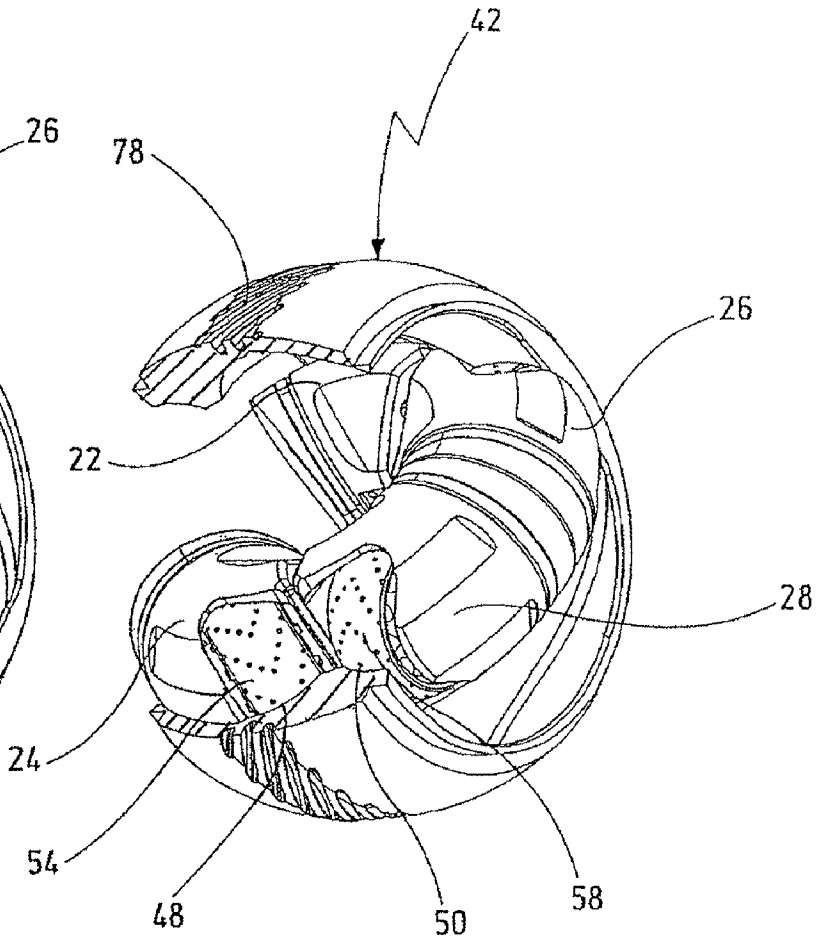
FIG. 7 shows the arrangement in FIG. 6, except that the pistons are in a different operating position from that shown in FIG. 6.
Figure 6:
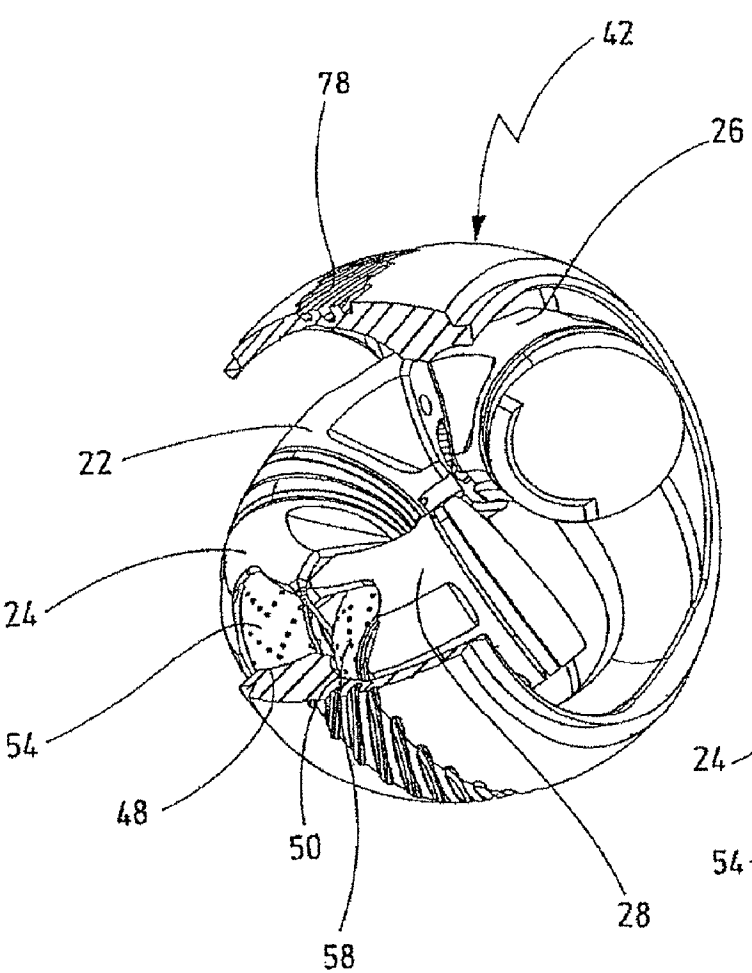
FIG. 6 shows a curve member of the piston machine in FIG. 1 in a partial perspective representation together with the pistons of the piston machine, the pistons being in a first operating position.

FIGS. 1 to 5 show a piston machine provided with the general reference sign 10. Further details of the piston machine are shown in FIGS. 6 and 7.

In the present embodiment, the piston machine 10 is used as an internal combustion machine, e.g. for use in a motor vehicle.

The piston machine 10 has a housing 12, which is constructed from a plurality of housing segments. The housing 12 has substantially the symmetry of a sphere, but is not limited to this.

In relation to an axis of revolution 14 which will be explained later, the housing 12 has a first housing end segment 16 and, opposite thereto, a second housing end segment 18, as well as one or more housing segments 20 around the axis of revolution 14 in the circumferential direction, as principal components of the housing 12.

Arranged in the housing 12 is a total of four pistons, namely a first piston 22, a second piston 24, a third piston 26 and a fourth piston 28.

Figure 2:
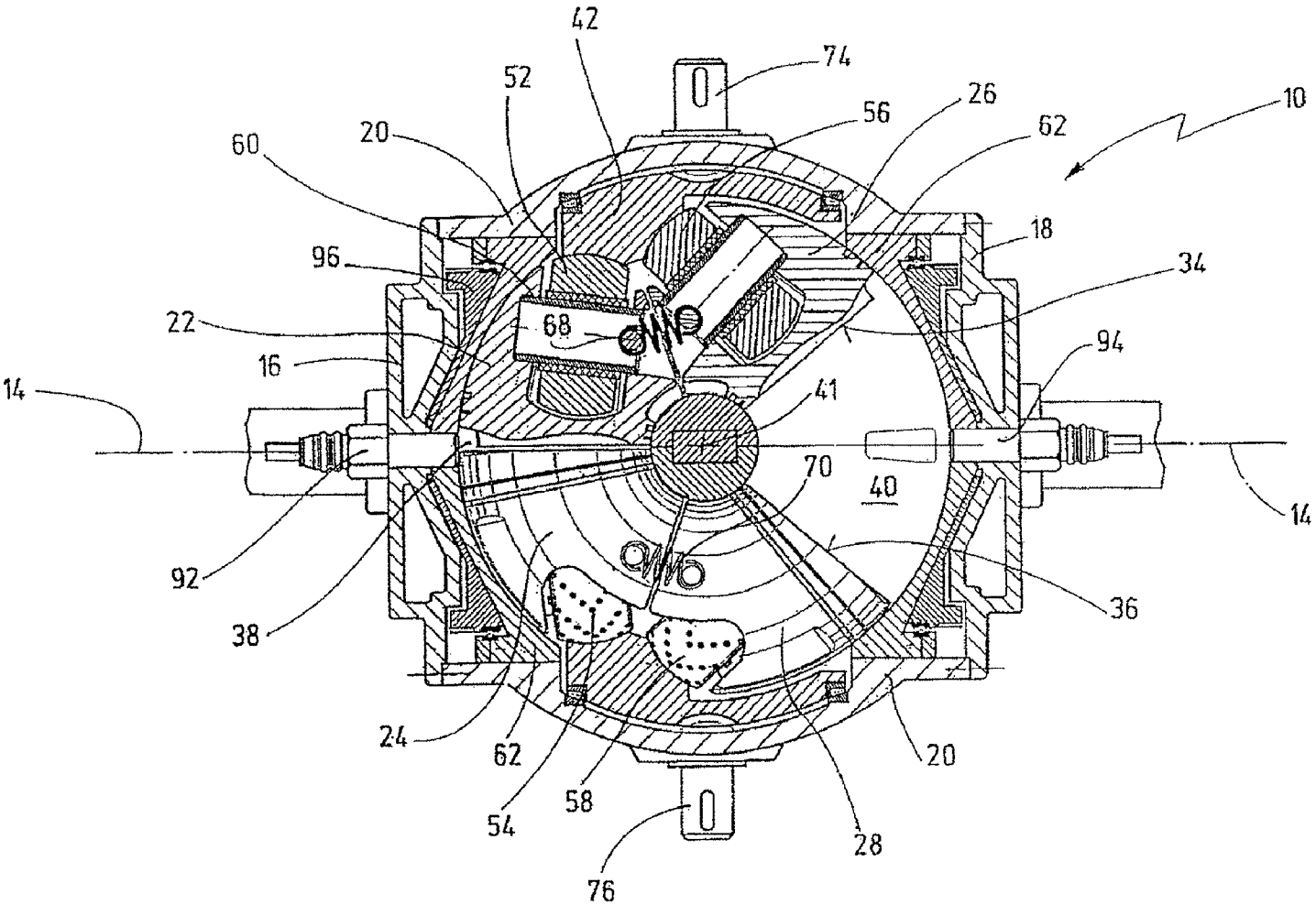
FIG. 2 shows the piston machine in FIG. 1 in a longitudinal section in a section plane along the axis of revolution but perpendicular to the section plane in FIG. 1, with cutaways in partial areas.
Figure 3:
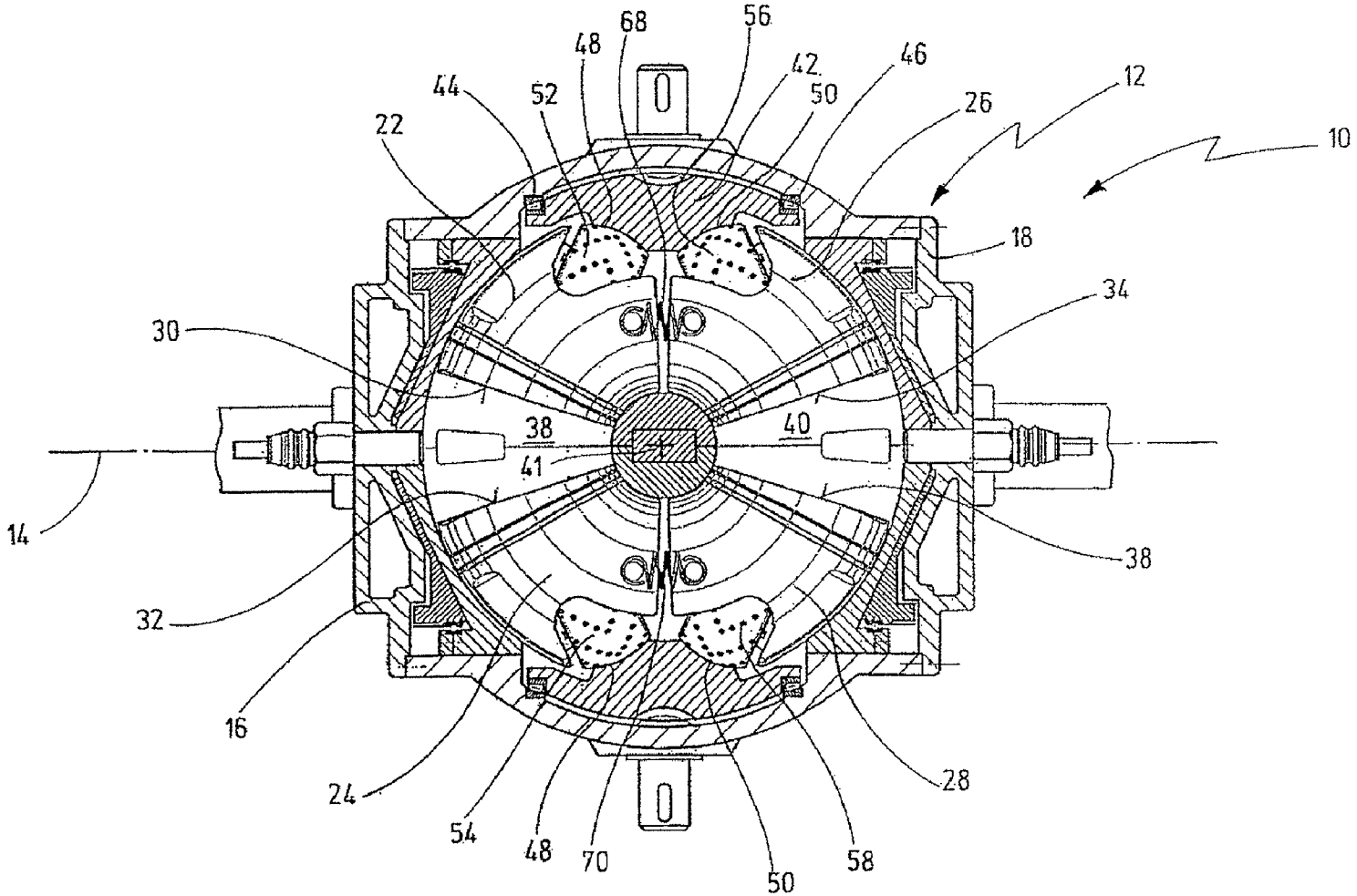
FIG. 3 shows the piston machine in FIG. 1 in a longitudinally sectioned representation in accordance with FIG. 2, with the pistons in an operating position different from that in FIGS. 1 and 2.
Figure 4:
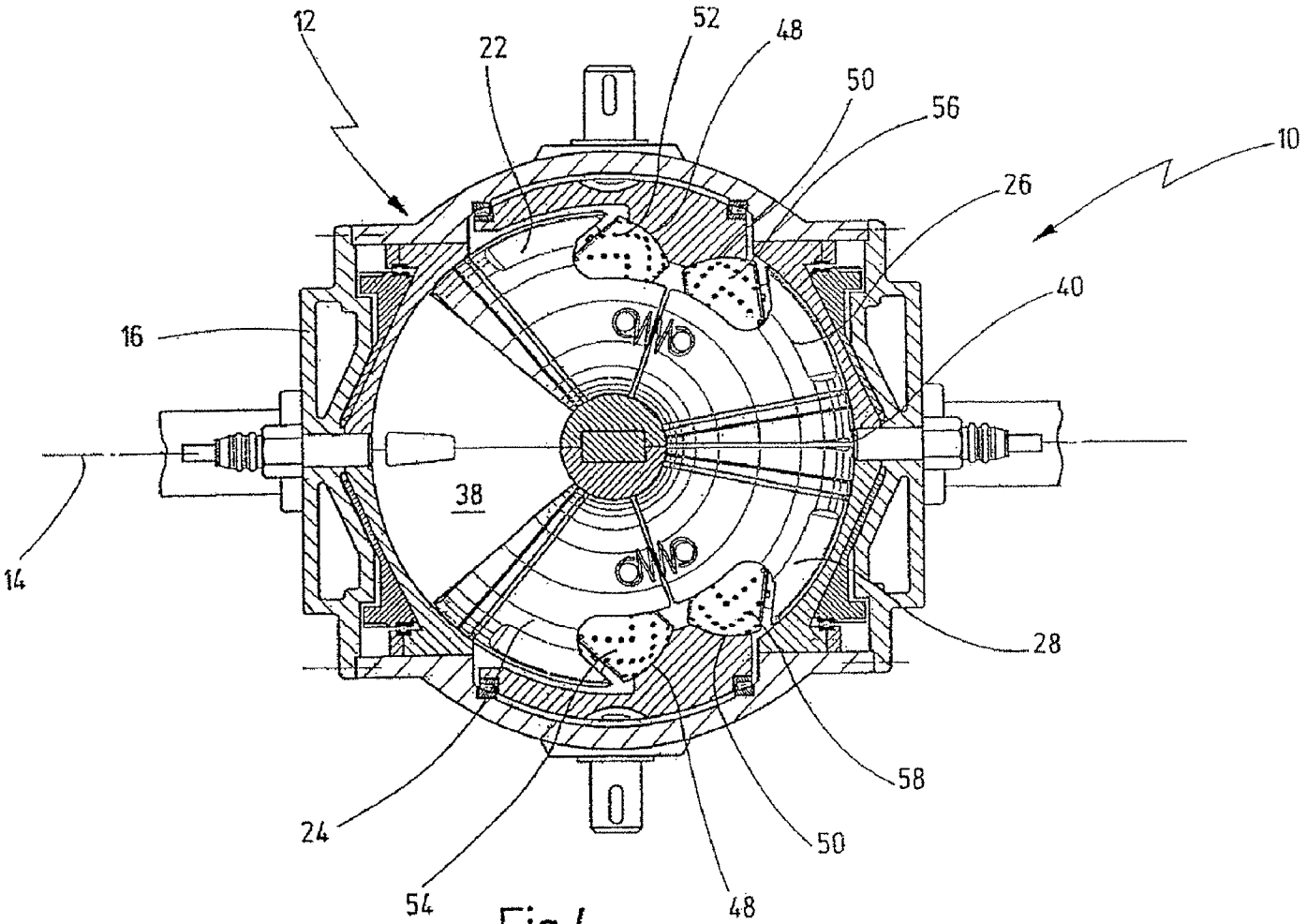
FIG. 4 shows the piston machine in FIG. 1 in a representation comparable to that in FIG. 3, with the pistons in another operating position.
Figure 5:
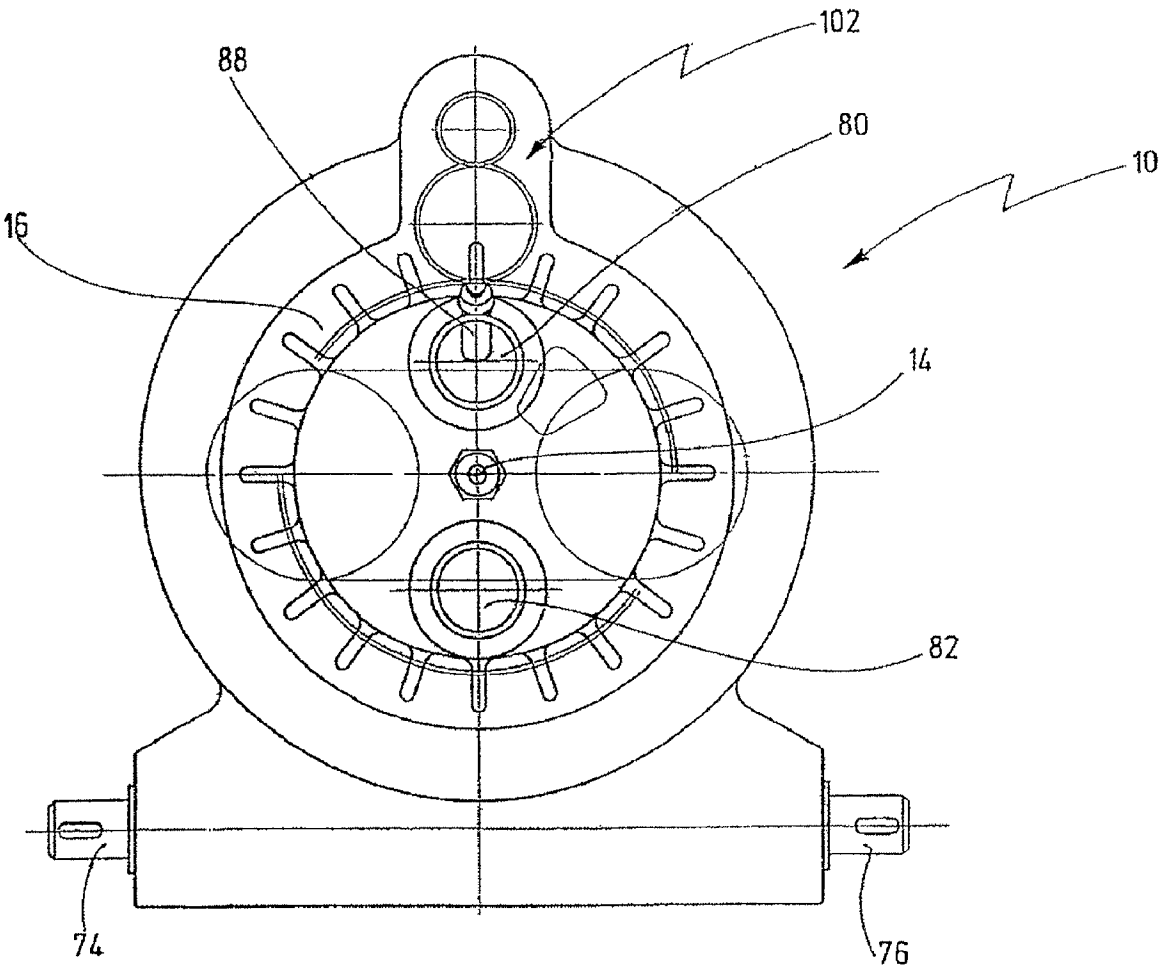
FIG. 5 shows an end view of the piston machine in FIG. 1.

All four pistons 22 to 28 are arranged in a common plane, as can be seen, in particular, from FIGS. 2 to 4.

The first piston 22 has a first end face 30, the second piston 24 a second end face 32, the third piston 26 a third end face 34 and the fourth piston 28 a fourth end face 36.

The first piston 22 and the second piston 24 define a first working chamber 38 between their respective end faces 30 and 32, and the third piston 26 and the fourth piston 28 define a second working chamber 40 between their end faces 34 and 36.

The pistons 22 to 28 perform reciprocating movements in the housing 12, these reciprocating movements taking place here in the form of pivoting movements about a pivoting axis 41 which extends perpendicularly to the abovementioned axis of revolution 14 and is fixed relative to the housing 12. Here, the pistons 22 to 28 are of correspondingly curved cylindrical design. It is self-evident that it would also be possible, in a modified embodiment, for the pistons 22 to 28 to perform linear reciprocating movements perpendicularly or obliquely with respect to the axis of revolution instead of pivoting movements, and accordingly would then not need to be curved.

To generate the reciprocating movements of the pistons 22 to 28, a curve member 42 is furthermore arranged in the housing 12.

The curve member 42 is designed as a ring which extends circumferentially all the way round the axis of revolution 14 and is continuous in the circumferential direction, and, in relation to the pistons 22 to 28, is situated radially to the outside of the pistons 22 to 28, as seen from the axis of revolution 14, and approximately centrally between the housing end segments 16 and 18 and approximately centrally in the housing 12.

The curve member 42 is mounted in the housing 12 in such a way that it can revolve about the axis of revolution 14 by means of two annular bearings 44, 46.

The curve member 42 can thus revolve in the housing 12 about the axis of revolution 14, which is to be understood to be a geometrical axis, the revolution of the curve member 42 serving to generate the reciprocating movements of the pistons 22 to 28.

For this purpose, the curve member 42 has a first control curve 48 and a second control curve 50, the two control curves 48, 50 being arranged axially adjacent to one another in relation to the axis of revolution and extending circumferentially all the way round the axis of revolution 14.

A guiding member 52, which is connected to the first piston 22, and a guiding member 54, which is connected to the second piston 24, are in engagement with control curve 48. A guiding member 56, which is connected to the third piston 26, and a guiding member 58, which is connected to the fourth piston 28, are in engagement with control curve 50.

The guiding members 52 to 58 are designed as running rollers and are arranged on the rear side of the pistons 22 to 28, the side which faces away from the respective end faces 30 to 36.

As illustrated by way of example in FIG. 2 for guiding member 52, this guiding member is mounted rotatably on the piston 22 by means of a journal 60, which is firmly connected to the piston 22.

It is also possible for the guiding members 52 to 58 to be formed by balls mounted in spherical sockets in the pistons 22 to 28, or by sliding shoes or differently shaped running rollers instead of running rollers of the type in the illustrative embodiment shown.

The pistons 22 to 28 are furthermore mounted in a sliding manner in a piston cage 62 which is fixed relative to the axis of revolution 14 in the housing 12, that is to say is connected in a rotationally fixed manner to the housing 12.

The piston cage 62 has a bore 64 for the first piston 22 and the second piston 24, the bore being circular in the present case, and has a bore 66 for the third piston 26 and the fourth piston 28, the said bore likewise being circular, pistons 22 and 24 thus being mounted in a sliding manner in bore 64, and pistons 26 and 28 being mounted in a sliding manner in bore 66. The pistons 22 to 28, which are preferably circular in cross section, can thus slide in bores 64 and 66 respectively while being sealed by means of circular seals (e.g. seals 68 of piston 22 in FIG. 3), with the result that the working chambers 38 and 40 are sealed off. Together with the end faces 30, 32 and 34, 36 respectively, the circumferential walls of the bores 64 and 66 delimit the working chambers 38 and 40 respectively, and the working chambers 38 and 40 thus have substantially the form of a cylinder.

As the curve member 42 revolves about the axis of revolution 14, the control curves 48 and 50 run along the guiding members 52 to 58, and the reciprocating movements of the pistons 22 to 28 are correspondingly generated in accordance with the contouring of the control curves 48 and 50, which consist of "hills" and "vales" in relation to the axis of revolution 14.

Each of the pistons 22 to 28 performs its reciprocating movements between two end positions, and during this process the movement of the pistons 22 to 28 always takes place in the same plane of movement, which is the plane of the drawing for the four pistons 22 to 28 in FIGS. 2 to 4. Thus the pistons 22 to 28 do not revolve around the axis of revolution 14 as in the known rotary piston machines. In contrast, the pistons 22 to 28 are always in a substantially central plane in the housing 12.

In this arrangement, the first piston 22 and the second piston 24 perform mutually opposing movements, and the third piston 26 and the fourth piston 28 likewise perform mutually opposing movements. In contrast, the reciprocating movements of the first piston 22 are in the same direction as those of the third piston 26, and the reciprocating movements of the second piston 24 are in the same direction as those of the fourth piston 28. The effect is that the working chambers 38 and 40 do not increase and decrease in size in the same sense but, while working chamber 38 is decreasing in volume, working chamber 40 is increasing and vice versa.

In FIG. 2, the first piston 22 and the second piston 24 are shown in their end position, which is referred to as top dead centre (TDC), in which pistons 22 and 24 have approached one another to the maximum extent and working chamber 38 accordingly has a minimum volume.

At the same time, pistons 26 and 28 are in an end position which is referred to as bottom dead centre (BDC), in which pistons 26 and 28 are spaced apart to the maximum extent and working chamber 40 accordingly has a maximum volume.

FIG. 3 shows an intermediate position of the pistons 22, 24 and 26, 28 respectively, in which the pistons 22 to 28 have moved half way out of their respective end position in FIG. 2 in the direction of the other end position. Underlying the transition from FIG. 2 to FIG. 3 is a 90° rotation of the curve member 42 about the axis of revolution 14.

FIG. 4 shows the reverse situation to that in FIG. 2 after a further 90° rotation starting from FIG. 3, and in this situation pistons 22 and 24 have reached their BDC position, while pistons 26 and 28 have reached their TDC position.

FIG. 6 shows the TDC position of pistons 22 and 24 and the simultaneous BDC position of pistons 26 and 28 together with the associated rotational position of the curve member 42 in perspective, and FIG. 7 shows the reverse situation, i.e. the TDC position of pistons 22 and 24 and the BDC position of pistons 26 and 28.

The first piston 22 and the third piston 26 are connected to one another on their rear sides, which face away from the end faces 30 and 34, preferably elastically, e.g. by means of a tension spring 68, and the second piston 24 and the fourth piston 28 are correspondingly likewise connected to one another, preferably elastically, e.g. by means of a tension spring 70. The connection between the first piston 22 and the third piston 26 and the connection between the second piston 24 and the fourth piston 28 brings about a mutual drag or entrainment effect between the first piston 22 and the third piston 26 and between the second piston 24 and the fourth piston 28, ensuring that the guiding members 52 to 58 are held securely in contact with the control curves 48 and 50 respectively of the curve member 42. The elastic connection between the pistons 22, 26 and 24, 28 respectively allows a slight elastic play between these pistons.

Figure 1:
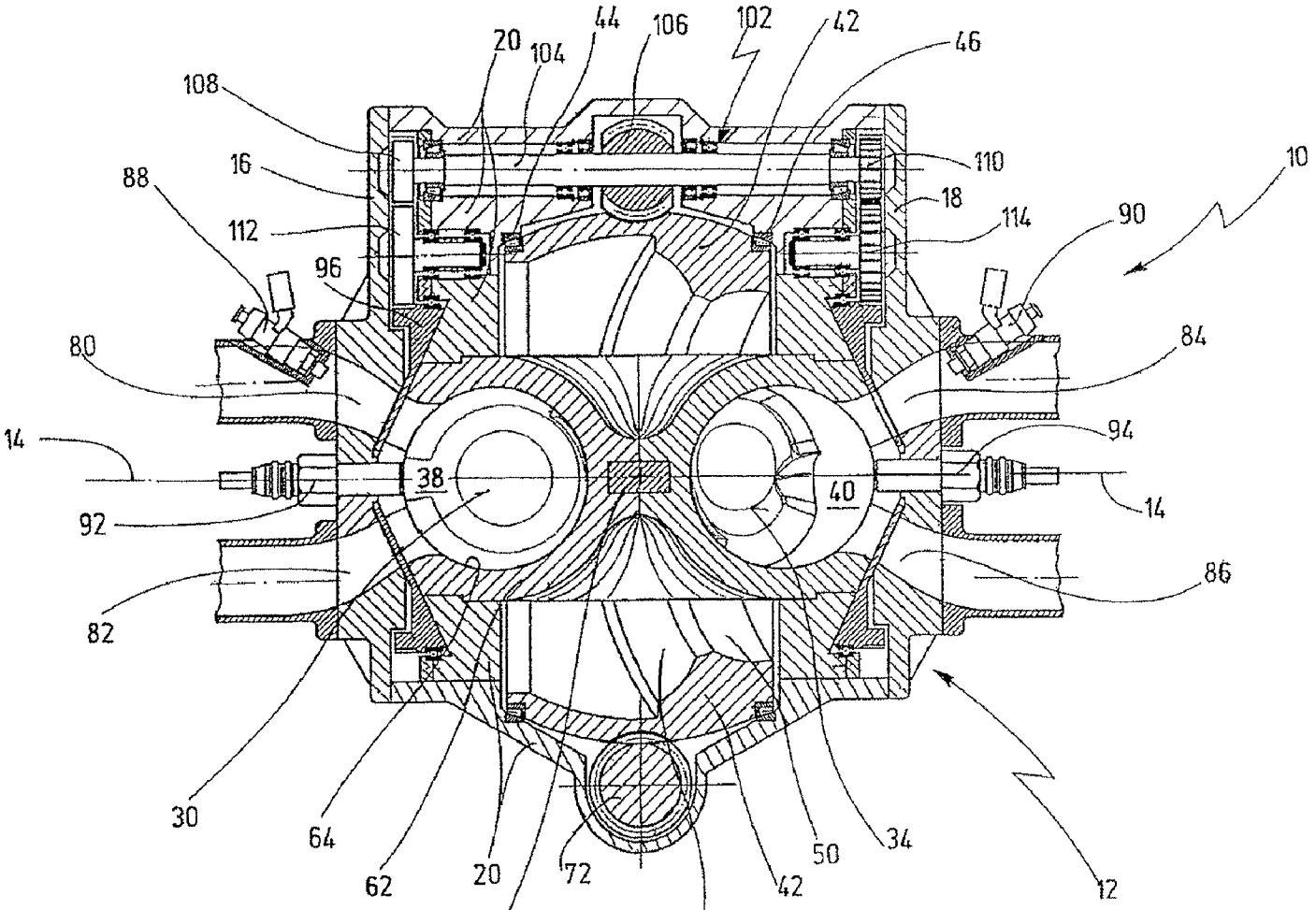
FIG. 1 shows a piston machine according to the invention in a longitudinally sectioned representation in a first section plane along the axis of revolution.

In order to use the revolution of the curve member 42 as a driving force in the operation of the piston machine 10, the curve member 42 is in operative connection with a shaft 72 (FIG. 1). FIGS. 2 to 4 show end portions 74, 76 of the shaft 72, to which the drive train of a vehicle or equipment, for example, can be connected.

According to FIGS. 6 and 7, the curve member 42 has worm toothing 78 on the outside, and the shaft 72 has corresponding external toothing, which meshes with the worm toothing 78 on the curve member 42 in such a way that the shaft 72 is made to revolve about its longitudinal centre line as the curve member 42 revolves about the axis of revolution 14. In this particularly simple embodiment, which requires only one set of toothing on these two parts and does not require any further parts of a gear mechanism for transmission of rotation between the curve member 42 and the shaft 72, the shaft 72 extends perpendicularly to the axis of revolution 14.

Further aspects of the piston machine 10 are described below.

A gas inlet 80 and a gas outlet 82 are assigned to the first working chamber 38, the gas inlet 80 and the gas outlet 82 being arranged in the immediate vicinity of the axis of revolution 14 in the housing end segment 16.

In a corresponding manner, a gas inlet 84 and a gas outlet 86 in housing segment 86 are assigned to working chamber 40.

A fuel feed device 88 is furthermore arranged in gas inlet 80, and a fuel feed device 90 is arranged in gas inlet 84.

A mixture of fresh air and fuel, which is fed in via the fuel feed device 88, e.g. an injector, can thus be introduced into working chamber 38 via gas inlet 80. While the introduction of fresh air is beginning in the TDC position of pistons 22 and 24, which then move into the BDC position, the fuel can also be injected just before the BDC position is reached. The pistons then move back into the TDC position, during which process the mixture is then compressed. In the new TDC position of pistons 22, 24, the mixture can then be ignited by means of an ignition device 92, e.g. a spark plug, whereupon pistons 22 and 24 are moved apart in an explosive manner, i.e. the operating stroke of expansion takes place. Once pistons 22 and 24 have reached the TDC position again, the burnt mixture is expelled via the gas outlet 82 as pistons 22 and 24 move back into the BDC position, a process familiar from four-stroke engines.

A corresponding ignition device 94 is provided for working chamber 40.

A rotary slide valve 96 is arranged in the housing 12 for the purpose of opening and closing gas inlet 80 and gas outlet 82, and a rotary slide valve 98 is arranged in the housing 12 for the purpose of closing gas inlet 84 and gas outlet 86.

Each of the two rotary slide valves 96 and 98 has just one opening, which is limited in terms of circumferential extent around the axis of revolution 14, the one opening 100 of the rotary slide valve 98 being visible in FIG. 1.

Both of the rotary slide valves 96 and 98 are mounted in the housing 12 in such a way that they can revolve about the axis of revolution 14, the rotary slide valves 96 and 98 revolving about the axis of revolution 14 at the same rotational speed as the curve member 42.

The revolution of the rotary slide valves 96 and 98 is derived from the revolution of the curve member 42, which is connected to the rotary slide valves 96 and 98 by means of a transmission 102, which converts the rotational speed of the curve member 42 into the rotational speed of the rotary slide valves 96 and 98 at a ratio of 1:1.

The transmission 102 has a shaft 104, which meshes by means of a gearwheel 106 with the external toothing 78 on the curve member 42 in order to impart to the shaft 104 a revolution about its longitudinal axis, the shaft 104 carrying at its ends gearwheels 108, 110 which mesh with gearwheels 112, 114, which in turn mesh with external toothing on the rotary slide valves 96, 98.

The fact that the revolution of the rotary slide valves 96, 98 is derived from the revolution of the curve member 42 ensures optimum synchronization of the rotational speed of the rotary slide valves 96 and 98 with the rotational speed of the curve member 42 and hence opening of the gas inlets 80, 84 and of the gas outlets 82, 86 at the respectively correct time as a function of the rotational speed of the curve member 42.

The operation of the piston machine 10 will be described in greater detail below with reference to FIG. 8.

The starting point for the description is the TDC position of pistons 22 and 24 and, in consequence, the BDC position of pistons 26 and 28. Working chamber 38 is thus at its minimum volume, and working chamber 40 at its maximum volume.

Figure 8:
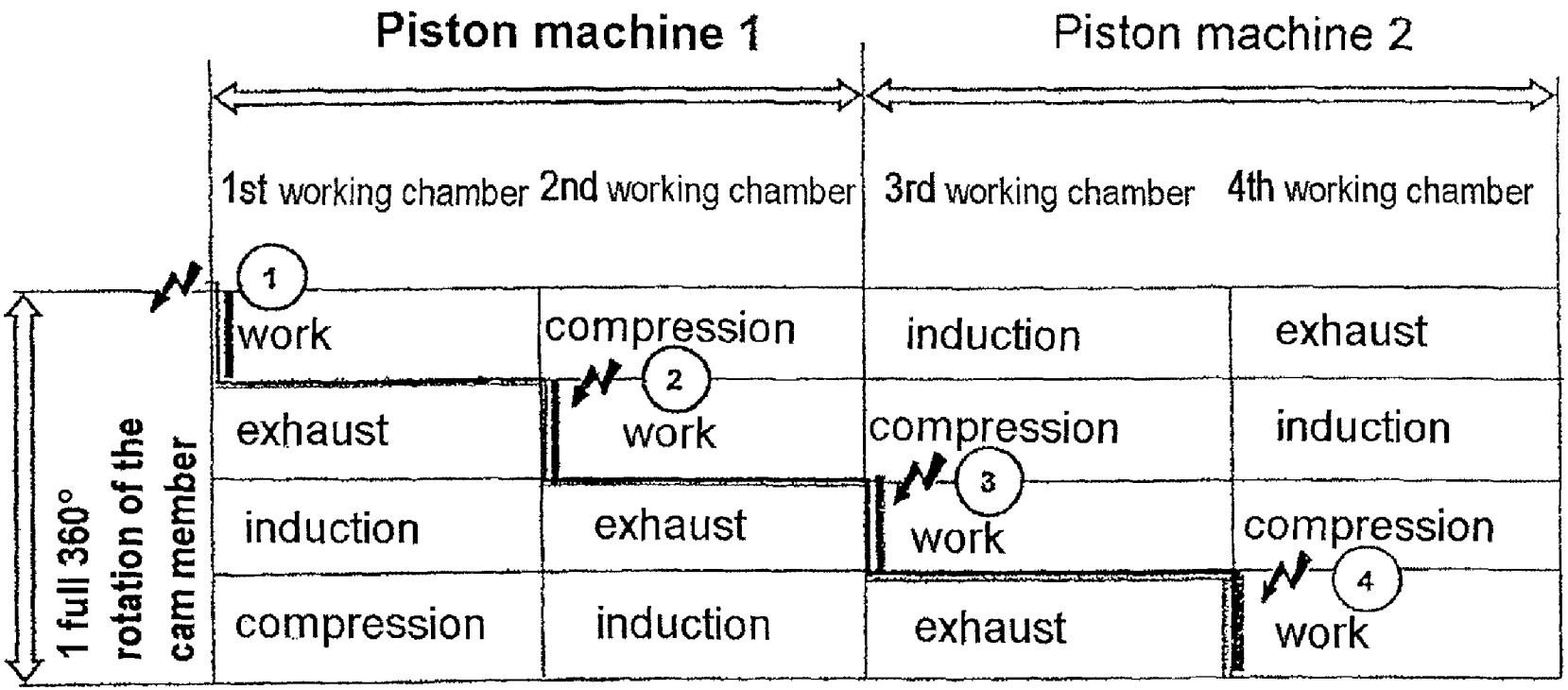
FIG. 8 shows a diagram which illustrates the sequence of operating strokes in two piston machines according to FIG. 1 connected in parallel.

If a fuel/air mixture has already been compressed in working chamber 38, it can be ignited in working chamber 38, starting from the TDC position of pistons 22 and 24, as indicated by an ignition spark in FIG. 8. After a 90° rotation of the curve member 42 about the axis of revolution 14, pistons 22 and 24 have then moved from the TDC position to the BDC position, and the operating stroke of work (expansion) has taken place.

Given appropriate positioning of rotary slide valve 98 in accordance with FIG. 1, a fuel/air mixture has been let into working chamber 40 and, during the 90° rotation of the curve member 42 as described above, pistons 26 and 28 move out of the BDC position and into the TDC position, as a result of which the fuel/air mixture in working chamber 40 is compressed.

Given a further 90° rotation of the curve member 42 about the axis of revolution 14, the operating stroke of exhausting the burnt fuel/air mixture then takes place in working chamber 38 while, in working chamber 40, the operating stroke of work (expansion) simultaneously takes place after ignition of the fuel/air mixture. At the end of this stroke, pistons 22, 24 are in the TDC position and pistons 26, 28 are in the BDC position.

During a further 90° rotation of the curve member 42 about the axis of revolution 14, the operating stroke of induction of new fuel/air mixture takes place in working chamber 38, and the operating stroke of exhausting the burnt fuel/air mixture takes place in working chamber 40. At the end of this stroke, pistons 22, 24 are in the BDC position and pistons 26, 28 are in the TDC position.

During a further rotation of the curve member 42 by 90° about the axis of revolution 14, the operating stroke of compression takes place in working chamber 38, and the operating stroke of induction of new fuel/air mixture takes place in working chamber 40. At the end of this stroke, pistons 22, 24 are in the TDC position, and pistons 26, 28 are in the BDC position.

During a full 360° rotation of the curve member 42 about the axis of revolution 14, the four operating strokes of work, exhaust, induction and compression thus take place in both working chambers 38 and 40, there being a phase shift of 90° in the operating strokes in working chamber 38.

If two piston machines 10 are now connected in parallel, a piston machine with a total of four working chambers is obtained, and if the arrangement is chosen such that the operating strokes in the two working chambers of the second piston machine are both phase-shifted by 90° with respect to one another and with respect to the operating strokes in working chambers 38 and 40 of the first piston machine 10, it is possible overall to obtain a piston machine in which an operating stroke of work (expansion) takes place during each rotation through 90° of the curve members, of which there are then two, thus ensuring that there is a continuous sequence of four strokes of work (expansion) for one 360° rotation, as in an 8-cylinder engine.

What is claimed is:

1. A piston machine, comprising a housing, a first piston arranged in said housing and having a first end face, said first piston being movable to and fro to perform reciprocating movements, a second piston arranged in said housing and having a second end face, said second piston being movable to and fro to perform reciprocating movements in opposite direction with respect to said reciprocating movements of said first piston, a working chamber arranged between said first and second end faces, said working chamber periodically increasing and decreasing in size upon said reciprocating movements of said first and second pistons, a guiding element arranged on at least one of said first and second pistons, a curve member arranged in said housing and extending concentrically and circumferentially about an axis of revolution fixed relative to said housing, said curve member being arranged radially outside of said first and second pistons with respect to said axis of revolution, said curve member being rotatable about said axis of revolution, while said first and second pistons being not-rotatable about said axis of revolution, a control curve formed on said curve member, said guiding element being in engagement with said control curve, wherein said reciprocating movements of said first and second pistons are derived independently of each other in a plane of movement which is fixed relative to said axis of revolution upon rotation of said curve member about said axis of revolution.

2. The piston machine of claim 1, wherein said guiding element is a first guiding element and is arranged on said first piston, wherein said second piston has a second guiding member, said first guiding member and said second guiding member being in engagement with said control curve of said curve member.

3. The piston machine of claim 1, wherein said axis of revolution extends centrally through said working chamber.

4. The piston machine of claim 1, further comprising a shaft, said shaft being in operative connection with said curve member, such that a rotation of said curve member about said axis of revolution is converted into a rotation of said shaft.

5. The piston machine of claim 4, wherein said shaft is connected to said curve member by worm toothing.

6. The piston machine of claim 1, further comprising a third piston and a forth piston arranged in said housing, said first and second pistons forming a first piston pair, said third and forth pistons forming a second piston pair, said second piston pair defining a second working chamber, which is arranged in a same plane as said working chamber defined by said first piston pair, and wherein reciprocating movements of said first and third pistons are in a same direction, and reciprocating movements of said second and forth pistons are in a same direction.

7. The piston machine of claim 6, wherein said third piston has a third guiding member and said forth piston has a forth guiding member, said third and forth guiding members engaging in a further control curve of said curve member.

8. A piston machine, comprising a housing, a first piston arranged in said housing and having a first end face, said first piston being movable to and fro to perform reciprocating movements, a second piston arranged in said housing and having a second end face, said second piston being movable to and fro to perform reciprocating movements in opposite direction with respect to said reciprocating movements of said first piston, a working chamber arranged between said first and second end faces, said working chamber periodically increasing and decreasing in size upon said reciprocating movements of said first and second pistons, a guiding element arranged on at least one of said first and second pistons, a curve member arranged in said housing and extending concentrically and circumferentially about an axis of revolution fixed relative to said housing, said curve member being arranged radially outside of said first and second pistons with respect to said axis of revolution, said curve member being rotatable about said axis of revolution, while said first and second pistons being not-rotatable about said axis of revolution, a control curve formed on said curve member, said guiding element being in engagement with said control curve, said first and second pistons performing said reciprocating movements in a plane of movement which is fixed relative to said axis of revolution upon rotation of said curve member about said axis of revolution, a third piston and a fourth piston arranged in said housing, said first and second pistons forming a first piston pair, said third and forth pistons forming a second piston pair, said second piston pair defining a second working chamber, which is arranged in a same plane as said working chamber defined by said first piston pair, wherein reciprocating movements of said first and third pistons are in a same direction, and reciprocating movements of said second and forth pistons are in a same direction, and wherein said first piston and said third piston are connected to one another on mutually facing sides of said first and third pistons, and said second piston and said forth piston are connected to one another on mutually facing sides of said second and forth pistons.

9. A piston machine, comprising a housing, a first piston arranged in said housing and having a first end face, said first piston being movable to and fro to perform reciprocating movements, a second piston arranged in said housing and having a second end face, said second piston being movable to and fro to perform reciprocating movements in opposite direction with respect to said reciprocating movements of said first piston, a working chamber arranged between said first and second end faces, said working chamber periodically increasing and decreasing in size upon said reciprocating movements of said first and second pistons, a guiding element arranged on at least one of said first and second pistons, a curve member arranged in said housing and extending concentrically and circumferentially about an axis of revolution fixed relative to said housing, said curve member being arranged radially outside of said first and second pistons with respect to said axis of revolution, said curve member being rotatable about said axis of revolution, while said first and second pistons being not-rotatable about said axis of revolution, a control curve formed on said curve member, said guiding element being in engagement with said control curve, said first and second pistons performing said reciprocating movements in a plane of movement which is fixed relative to said axis of revolution upon rotation of said curve member about said axis of revolution, and a piston cage fixed relative to said housing, wherein said first and second pistons are mounted in a sliding manner in said piston cage.

10. A piston machine, comprising a housing, a first piston arranged in said housing and having a first end face, said first piston being movable to and fro to perform reciprocating movements, a second piston arranged in said housing and having a second end face, said second piston being movable to and fro to perform reciprocating movements in opposite direction with respect to said reciprocating movements of said first piston, a working chamber arranged between said first and second end faces, said working chamber periodically increasing and decreasing in size upon said reciprocating movements of said first and second pistons, a guiding element arranged on at least one of said first and second pistons, a curve member arranged in said housing and extending concentrically and circumferentially about an axis of revolution fixed relative to said housing, said curve member being arranged radially outside of said first and second pistons with respect to said axis of revolution, said curve member being rotatable about said axis of revolution, while said first and second pistons being not-rotatable about said axis of revolution, a control curve formed on said curve member, said guiding element being in engagement with said control curve, said first and second pistons performing said reciprocating movements in a plane of movement which is fixed relative to said axis of revolution upon rotation of said curve member about said axis of revolution, and a gas inlet and a gas outlet arranged in said housing at an end of said housing in relation to said axis of revolution, said gas inlet and said gas outlet being opened and closed by a rotary slide valve which has an opening and which rotates about said axis of revolution at a same rotational speed as said curve member.

11. The piston machine of claim 10, wherein rotation of said rotary slide valve is derived from rotation of said curve member via a transmission with a rotational speed ratio of 1:1.

* * * * *